United States Patent [19]

Roth

[11] Patent Number: 5,067,332

[45] Date of Patent: Nov. 26, 1991

[54] GUIDE BAR BEARING FOR WARP KNITTING MACHINES

[75] Inventor: Josef Roth, Seligenstadt, Fed. Rep. of Germany

[73] Assignee: Karl Mayer Textilmaschinenfabrik GmbH, Obertshausen, Fed. Rep. of Germany

[21] Appl. No.: 392,440

[22] Filed: Aug. 11, 1989

[30] Foreign Application Priority Data

Aug. 22, 1988 [DE] Fed. Rep. of Germany ..... 3828469

[51] Int. Cl.[5] ..... D04B 27/06

[52] U.S. Cl. ..... 66/207

[58] Field of Search ..... 66/207, 204; 112/80.41

[56] References Cited

U.S. PATENT DOCUMENTS

| | | | |
|---|---|---|---|
| 2,306,906 | 12/1942 | Schönfeld et al. | 66/207 |
| 2,451,187 | 10/1948 | Young | 66/207 |
| 2,515,253 | 7/1950 | Noe | 66/207 |
| 2,782,617 | 2/1957 | Noe | 66/207 |
| 3,099,920 | 8/1963 | Liebrandt et al. | 66/207 |
| 3,148,519 | 9/1964 | Kulczycki | 66/207 |
| 3,303,670 | 2/1967 | Bassist | 66/207 |
| 4,876,862 | 10/1989 | Zorini | 66/207 |

*Primary Examiner*—Werner H. Schroeder
*Assistant Examiner*—John J. Calvert
*Attorney, Agent, or Firm*—Omri M. Behr

[57] ABSTRACT

A guide arrangement for a warp knitting machine includes a guide bar bracket and a guide bar frame. A guide bar is attached to the guide bar frame. Also included is a connecting arrangement connecting between the guide bar frame and the guide bar bracket. The connecting arrangement has at least one linear bearing bolt attached to the guide bar bracket. The connecting arrangement also has a bearing slidable relative to the linear bearing bolt. This bearing is attached to the guide bar frame.

11 Claims, 2 Drawing Sheets

GUIDE BAR BEARING FOR WARP KNITTING MACHINES

BACKGROUND OF THE INVENTION

The invention relates to a guide bar bearing arrangement for warp knitting machines comprising a guide bar bracket and guide bar frame connected together through a connecting arrangement and, in particular, to a connecting arrangement having at least one linear bearing bolt and a bearing displaceable with respect thereto, as well as, a guide bar which is attached to the guide bar frame.

An arrangement of this type is known from German Utility Model DE-GM 1857100. In this arrangement the guide bars are carried by the frame in which the linear bearing bolts are fastened. The linear bearing bolts are located in roller bearing sleeves in the guide bar bracket and are axially displaceable therein. It has been shown in practice that in this arrangement, substantial frictional losses occur in the drive means. Specifically, losses occur at the roller and the cam which transmit the axial movement required by the fabric design features, to the guides themselves.

It is therefore the purpose of the present invention to provide for a guide bar a bearing arrangement which operates with a lower level of frictional loss when interacting with the parts to be moved.

SUMMARY OF THE INVENTION

In accordance with the illustrative embodiments demonstrating features and advantages of the present invention, there is provided a guide arrangement for a warp knitting machine. This guide arrangement includes a guide bar bracket and a guide bar frame. A guide bar is attached to the guide bar frame. Also included is a connecting arrangement connecting between the guide bar frame and the guide bar bracket. The connecting arrangement has at least one linear bearing bolt attached to the guide bar bracket. The connecting arrangement also has a bearing slidable relative to the linear bearing bolt. This bearing is attached to the guide bar frame.

Accordingly an improved guide bar bearing arrangement is achieved when the linear bearing bolt is attached to the guide bar bracket and the bearing itself is attached to the guide bar frame. This mode of construction gives rise to a substantial savings in weight in the moving parts. This, in turn, reduces the mass which must be accelerated. Also the drive means is subject to less stress.

Furthermore, the return spring for returning the guide bar can be reduced in size which thus, similarly reduces the power required for the return action. Utilizing a smaller return spring reduces the forces acting upon the drive means.

The bolt, which because of the carrying task ascribed to it, is generally speaking constructed as a rather massive part, need no longer move in the new arrangement. The builder of the equipment is thus provided with a range of choices in selecting the size of the bolts. In one embodiment the bolts can be decreased in size since they no longer need to carry their own weight. This can lead to savings in construction costs. Equally, the bolts can be made larger than heretofore because their weight, relative to the mass of the guide bar to be moved is no longer relevant. This in turn leads to a more solid fixing of the guide bar frame.

Generally speaking a guide bar bracket can be constructed in a distortion free manner more readily than the guide bar frame. When the bolts are rigidly fixed in the guide bar bracket there is provided a greater security against distortion of the bearings with respect to each other, which previously caused misalignment of the bolts from their normally parallel relation with each other.

The savings in weight also permits a higher working speed of the equipment without an increase in frictional losses. A portion of the weight saving can be utilized to make the guide bar more stable so that it no longer vibrates too readily. When the guide bar is more stable, it is possible to reduce the number of guide bar frames which, in turn, leads to an additional savings in weight.

Furthermore, the arrangement in accordance with the present invention requires a smaller return spring which again results in a cost savings.

In a particularly preferred embodiment the center of gravity of the guide bar frame is located in a region perpendicularly below the bearing, this results in a very small moment of rotation being exercised upon the bearing. Thus, it is no longer so necessary to guard the bearing against binding due to misalignment.

It has been found desirable that the guide bar frame comprises a fastening flange for the guide bar whose width is between 1½ and 2½ times (preferably 2 times) the width of the guide bar frame. Such an arrangement permits the weight of the guide bar frame to be reduced further. The marginal loss of stability of the guide bar bearing can be compensated for by constructing the guide bar in a somewhat more rigid manner.

It is further desirable that the fastening flange be symmetrical to the central axis of the guide bar frame. This geometry serves to reduce the turning moment on the bearing as much as possible.

It is further advantageous that the guide bar frames are provided in the area of their upper and lower ends with a pair of mutually parallel sleeves, operating as bearings. Since the guide bar frames need only slide back and forth on the guide bolts, they can be slighter than when they must support the bolts themselves. The demands on the guide bar frames are much greater when they must hold the slide bolts fixed and parallel to each other, that is to say, secured against distortion.

It is preferred that the sleeves are connected to each other by means of ribs. This arrangement leads to a further saving in weight in contrast to a massive solid construction form for the guide bar frames. It is particularly advantageous to provide the guide bar frames in H-shaped cross sections with two border ribs and one transverse rib. This gives rise to a greater degree of rigidity while utilizing a smaller amount of material.

It is further preferred that the width of the border ribs should correspond to the outer cross-section of the sleeve. (The term breath is not intended to mean the height of the border ribs, but rather its dimension in a plane perpendicular to the axis of the bolt.) This provides the guide bar frame with a compact form which has been found to be useful in the retention of the bearing and is also advantageous in construction.

It is also preferred that the breadth of the transverse bar, that is to say, the dimension in the direction of the bolt axis, corresponds to the length of the sleeve. The guide bar frame is thus provided with a compact form which does not interfere on the one hand, with the axial movement possibilities of the guide bar frame and on the other hand, yields the greatest possible stability.

It is further advantageous that the transverse rib extends beyond the border bars and protrudes outwardly. That is to say, the border bars are not necessarily located at the end of the sleeve but are somewhat displaced towards the middle of the sleeves. This enables a simple upper surface treatment of the face side of the sleeves since only the face surface of the transverse bar need be involved.

It is advantageous that the guide bar frames are forged. This gives rise to a weight savings relative to a cast guide bar frame since, forged materials have a higher rigidity then cost ones.

In a preferred embodiment the height of the guide bars is at least double that of their width, this provides an additional stability in the up and down movement direction.

It is particularly preferred that the guide bar height is 2½ times the breadth.

BRIEF DESCRIPTION OF THE DRAWINGS

The above brief description as well as other objects, features and advantages of the present invention will be more fully appreciated by reference to the following detailed description of presently preferred but nonetheless illustrative embodiments, in accordance with the present invention, when taken in conjunction with the accompanying drawings wherein.

DESCRIPTION OF THE PREFERRED EMBODIMENTS

Figure 1:
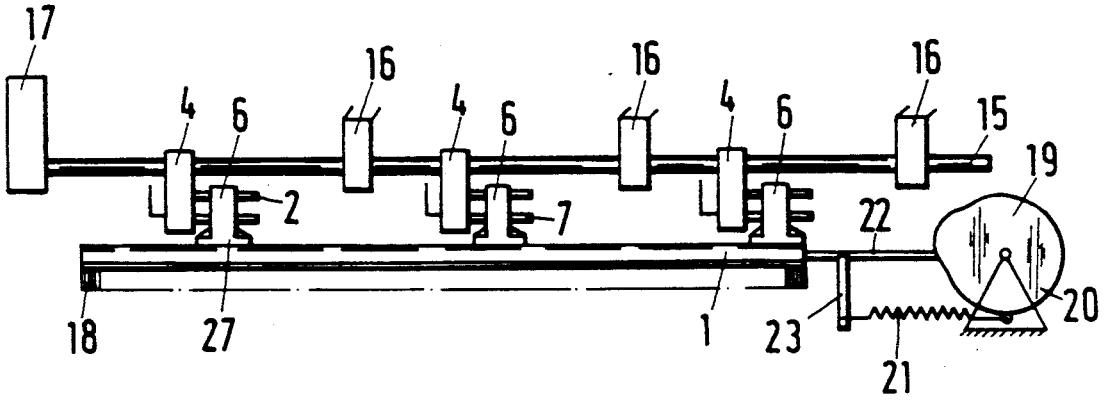
FIG. 1 is a general elevational view of the guide bar arrangement.

Referring to FIG. 1, guide bar 1 having guides 18 attached thereto is moveable to and from by means of a guide rod 22. Guide rod 22 is axially reciprocatable to interact with cam 19 mounted in a cam bearing 20. The movement to the left in the drawing occurs upon the action of a protuberance shown in cam 19 upon guide bars 22 through guide rod 22. The return movement, which is shown in the drawing as being directed to the right, occurs by means of spring 21 which is located between the spring connection 23 and the cam bearing 20.

Guide bar 1 is carried by a plurality of guide bar frames 6 each of which is provided with a guide bar bracket 4 so that guide bar 1 is moveable with respect to said guide bar brackets 4. Guide bar brackets 4 are affixed in a non-rotatable fashion to a common shaft 15 which in turn is rotatably mounted in bearing 16. The shaft 15 is rotatable through a predetermined angle by swing lever 17.

In each guide bar bracket 4 there are provided two mutually parallel linear bearing bolts 2 and 7 which are fixed so as to be immovable with respect to each other. Since the guide bar brackets 4 may be constructed in stable ways, the possibility that the linear bearing bolts 2 and 7 lose their mutual parallelism and become distorted with respect to each other is exceedingly small.

Figure 2:
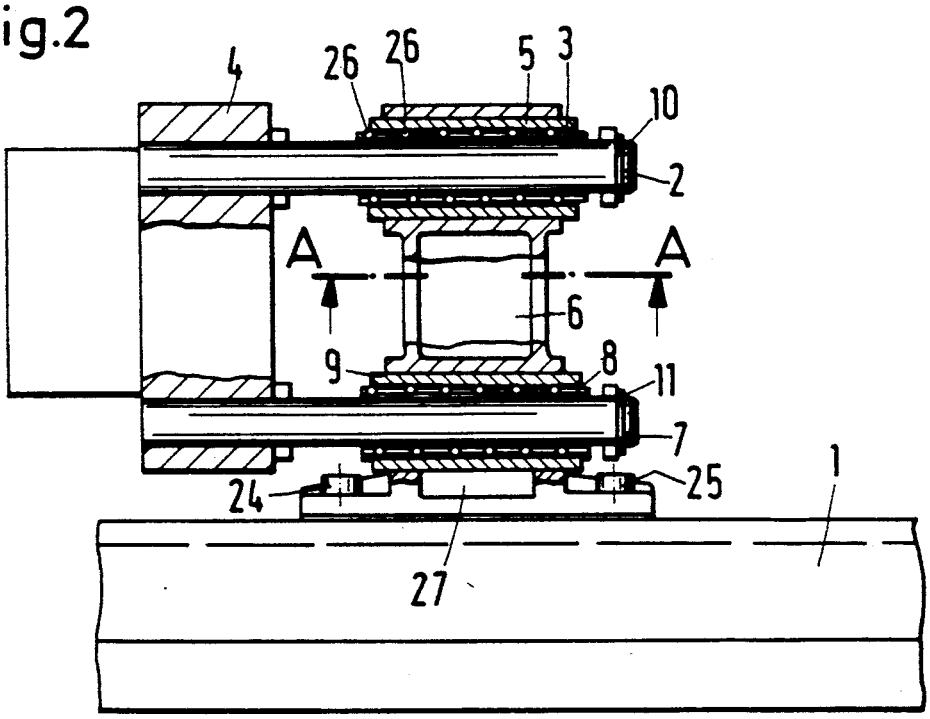
FIG. 2 is a detailed view of a portion of FIG. 1.
Figure 3:
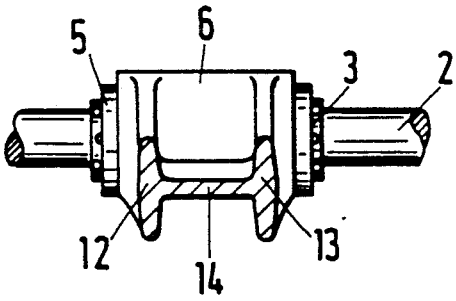
FIG. 3 is a transverse-section of FIG. 2 taken along line A—A.
Figure 4:
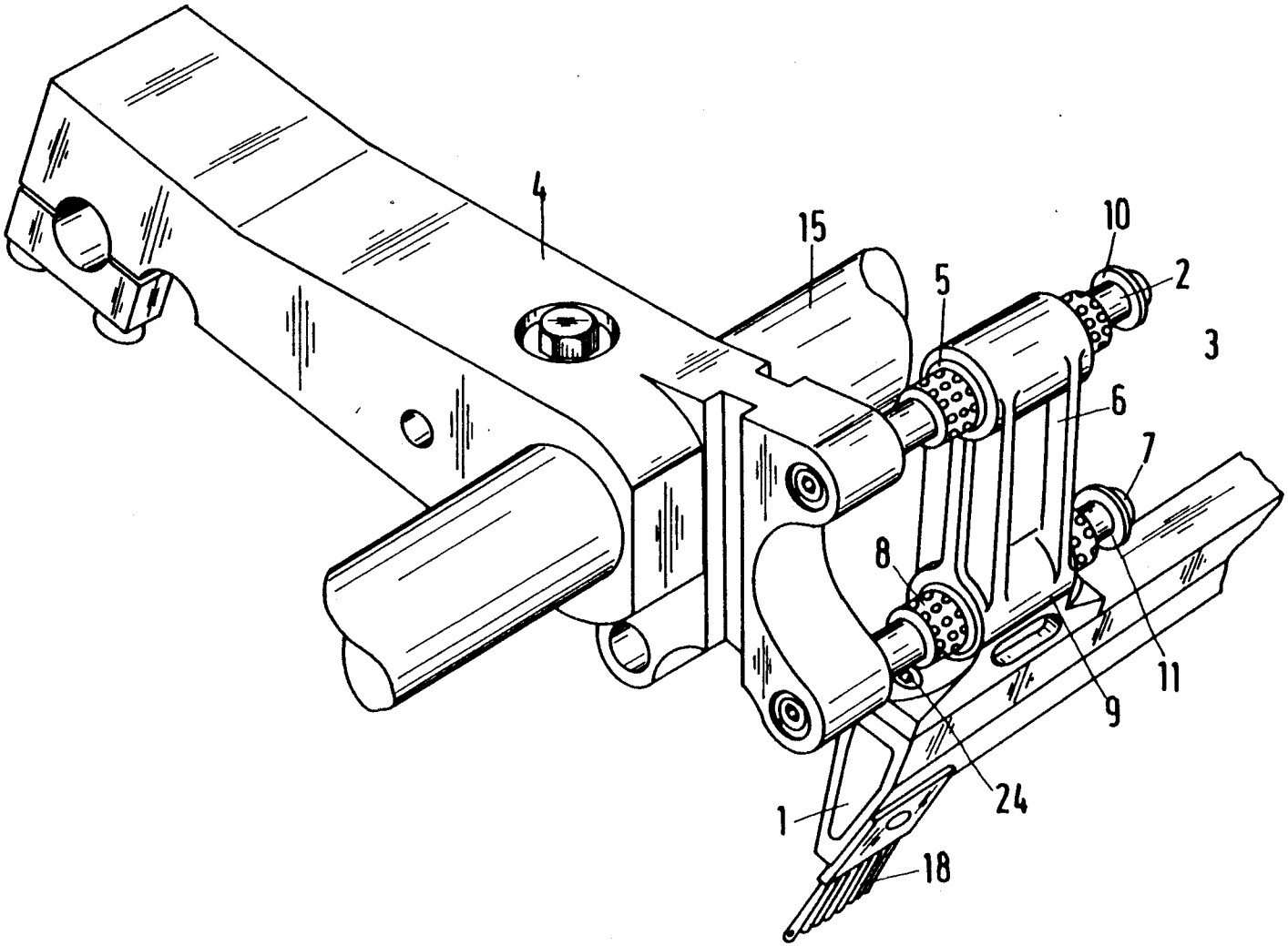
FIG. 4 is a perspective view of a portion of the guide bar bearing arrangement of FIG. 1.

Referring to FIGS. 2, 3 and 4, each guide bar frame 6 comprises two hollow cylindrical sleeves 5 and 9 in which linear bearing bolts 2 and 7 are slidably mounted and which form the bearing of the guide bar frame 6.

Basically, all types of bearings which permit an axial movement are permitted, that is to say, slide bearings. In the illustrated case however, ball bearings are preferred in which the balls 26 are provided in ball bearing sleeves 3 and 8. The balls 26 are permanently held in the ball bearing sleeves 3 and 8, all located in the annular space between sleeves 5, 9 and bolts 2, 7. The movement of the ball bearing sleeves 3 and 8 on the linear bearing bolts 2 and 7 are limited on the one side by guide bar bracket 4 and on the other side by split rings 10 and 11 which are lodged in a groove at the end of the linear bearing bolts 2 and 7.

The ball bearing sleeves themselves 3 and 8 move with half the relative speed of guide bar frame 6, with respect to the fixed linear bearing bolts 2 and 7. When the ball bearing sleeves 3 and 8 find themselves in their rightmost position, that is to say, in contact with the split rings 10 and 11, the guide bar frame 6 similarly finds itself in the rightmost setting. Thus the rightmost face of the sleeves 5 and 9 come close to alignment with the face of the ball bearing sleeves 3 and 8. When the ball bearing sleeves 3 and 8 are at their leftmost end position, that is to say, in contact with guide bar bracket 4, the guide bar frames 6 similarly find themselves at the leftmost end of the linear bearing bolts 7. Thus the left face of sleeves 5 and 9 are substantially in alignment with the left face of the ball bearing sleeves 3 and 8.

Thus the ball bearing sleeves 3 and 8 are longer than sleeves 5 and 9 of the guide bar frame 6 and, in fact, preferably by an amount approximately half the distance by which the guide bar is displaced.

Referring to FIGS. 2 and 3, the two sleeves 5 and 9 of the guide bar frame 6 are connected to each other by means of ribs which have an H-shaped transverse section. This H comprises two border ribs 12 and 13 and a transverse rib 14 which is located in the middle of the border ribs 12 and 13 over the entire breadth of the guide bar frame 6, that is to say, over the entire length of sleeves 5 and 9. The border ribs 12 and 13 are not located directly at the face ends of guide bar frame 6 but are displaced somewhat towards the middle, so that treatment of the face surfaces of sleeves 5 and 9 is readily possible without the need for operation upon the longitudinal ribs 12 and 13 in this particular location.

The width of the border ribs 12 and 13 correspond substantially to the external diameter of sleeves 5 and 9. The guide bar frames 6 are thus provided with a compact outer surface since no part extends outwardly. They are thus easily stackable which considerably simplifies storage and handling.

Guide bar frames 6 terminate in the direction of guide bar 1 in a flange 27, which has a breadth of approximately 1½ to 2½ times the breadth of guide bar frame 6. It is particularly desirable that this be a two-fold breadth. In the ends of the flange 27 located over the breadth of the guide bar frame, holes are provided through which screws 24 and 25 may be passed in order to secure the guide bar 1 to the guide bar frame 6.

Guide bar 1 should be at least twice as high as it is broad. The breadth is thus the dimension measurable perpendicular to the plane of the drawing of FIG. 2. This provides guide bar 1 with a relatively high rigidity in the direction perpendicular to the axial displacement direction of the guide bar frame, that is to say, in the direction parallel to the longitudinal axis of the guides 18 (FIG. 1).

A movement in this direction during operation, overlays the axial displacement movement and can, with improper dimensioning, readily lead to a through-swing of the guide bars. This is prevented by means of the stability introduced into the guide bar 1.

In order to construct the guide bar 1, frame 6 is fixed to the guide bar by means of screws 24 and 25. Thereafter, guide bar frames 6 are slid on to the linear bearing bolts 2 and 7. Then the split rings 10 and 11 are mounted on the linear bearing bolts 2 and 7 in order to secure the guide bar frames 6 therein.

I claim:

1. Guide arrangement for a warp knitting machine comprising:

a guide bar bracket;

a guide bar frame having an upper and lower end and wherein said bearings comprise;

two parallel sleeves separately affixed about said upper and lower ends of said guide bar frame;

a guide bar attached to said guide bar frame; and a connecting arrangement connecting between said guide bar frame and said guide bar bracket, and comprising:

(a) at least one linear bearing bolt attached to said guide bar bracket; and (b) a bearing slidable relative to said linear bearing bold, said bearing being attached to said guide bar frame and having a ribbed bar having one transverse rib, the breadth of the transverse rib corresponding to the length of the sleeves.

2. Guide arrangement in accordance with claim 1, wherein the center of gravity of the guide bar frame 1 is locateable in a region perpendicularly below said bearing.

3. Guide arrangement in accordance with claim 2, wherein said guide bar frame comprises:

an affixing flange for attaching to said guide bar, said flange having a breadth between 1½ and 2½ times, nominally 2 times, the breadth of the guide bar frame.

4. Guide arrangement in accordance with claim 3, wherein the affixing flange is symmetrical with respect to the central axis of the guide bar frame, said central axis being perpendicular to the guide bar.

5. Guide arrangement in accordance with claim 1, wherein the ribbed bar has an H-shaped transverse section having two border ribs and one transverse rib.

6. Guide arrangement in accordance with claim 1, wherein the ribbed bar has two border ribs and one transverse rib and wherein the breadth of the border ribs correspond to the outer diameter of the parallel sleeves.

7. Guide arrangement in accordance with claim 1, wherein the transverse rib protrudes beyond the border ribs in an outward direction.

8. Guide arrangement in accordance with claim 7, wherein the guide bar frame is forged.

9. Guide arrangement in accordance with claim 8, wherein the guide bar height is at least twice its breadth.

10. Guide arrangement in accordance with claim 9, wherein the guide bar height is 2½ times the breadth.

11. Guide arrangement for a warp knitting machine comprising:

a guide bar bracket;

a guide bar frame having an upper and lower end and wherein said bearings comprise;

two parallel sleeves separately affixed about said upper and lower ends of said guide bar frame;

a guide bar attached to said guide bar frame; and a connecting arrangement connecting between said guide bar frame and said guide bar bracket, and comprising:

(a) at least one linear bearing bolt attached to said guide bar bracket; and (b) a bearing slidable relative to said linear bearing bold, said bearing being attached to said guide bar frame and having a ribbed bar of H-shaped transverse section having two border ribs and one transverse rib, the breadth of the transverse rib corresponding to the length of the sleeves.

* * * * *